United States Patent [19]

Wahl

[11] Patent Number: 4,622,745

[45] Date of Patent: Nov. 18, 1986

[54] HAIR TRIMMING APPARATUS

[75] Inventor: Gregory S. Wahl, Sterling, Ill.

[73] Assignee: Wahl Clipper Corporation, Sterling, Ill.

[21] Appl. No.: 655,907

[22] Filed: Sep. 28, 1984

[51] Int. Cl.[4] ..... B26B 19/20

[52] U.S. Cl. ..... 30/201

[58] Field of Search ..... 30/201, 200, 202, 30

[56] References Cited

U.S. PATENT DOCUMENTS

| | | | |
|---|---|---|---|
| 237,090 | 1/1981 | Candrian . | |
| 336,890 | 3/1986 | Burwell . | |
| 347,207 | 8/1986 | Smith et al. . | |
| 481,977 | 9/1892 | Smith . | |
| 628,002 | 4/1899 | Hasch . | |
| 685,707 | 10/1901 | Archer . | |
| 835,259 | 11/1906 | Scharff . | |
| 974,604 | 11/1910 | Schneider . | |
| 1,214,430 | 1/1917 | Cook . | |
| 1,395,104 | 10/1921 | Gray . | |
| 1,399,103 | 12/1921 | Butler . | |
| 1,423,363 | 4/1922 | Severson . | |
| 1,471,970 | 10/1923 | McElroy . | |
| 1,533,564 | 4/1925 | Mani . | |
| 1,621,572 | 3/1927 | Young . | |
| 1,628,421 | 5/1927 | Patenaude . | |
| 1,745,997 | 2/1930 | Kocourek et al. | 30/201 |
| 1,753,750 | 4/1930 | McArdle et al. . | |
| 1,795,836 | 3/1931 | Cordova . | |
| 1,899,102 | 2/1933 | Michael . | |
| 1,964,019 | 6/1934 | Adelmo . | |
| 1,988,199 | 1/1935 | Greco et al. . | |
| 2,103,418 | 12/1937 | Hagelbeuker . | |
| 2,229,688 | 1/1941 | Waldron . | |
| 2,237,676 | 4/1941 | Lewis . | |
| 2,291,439 | 4/1942 | Andis . | |
| 2,309,175 | 1/1943 | Doggett | 30/200 |
| 2,317,928 | 4/1943 | Martell | 30/200 |
| 2,481,097 | 9/1949 | Fewins | 30/200 |
| 2,517,999 | 8/1950 | Giorgi | 30/201 |
| 2,544,052 | 3/1951 | Scott | 30/201 |
| 2,593,168 | 4/1952 | Monyhan | 30/201 |
| 2,611,951 | 9/1952 | Tully . | |
| 2,665,476 | 1/1954 | Leonard . | |
| 2,708,942 | 5/1955 | Fiddyment . | |
| 2,713,718 | 4/1955 | Hudson | 30/200 |
| 2,716,809 | 9/1955 | Malone . | |
| 2,718,696 | 9/1955 | Green | 30/200 |
| 2,722,741 | 11/1955 | McAuliffe | 30/201 |
| 2,726,447 | 12/1955 | Maloy . | |
| 2,746,144 | 5/1956 | Spanel . | |
| 2,780,868 | 2/1957 | Brown | 30/200 |
| 2,789,348 | 4/1957 | Clark . | |
| 2,880,504 | 4/1959 | Finn | 30/201 X |
| 2,896,323 | 7/1959 | Guerra et al. | 30/201 |
| 2,915,070 | 12/1959 | Benson | 132/45 |
| 2,916,820 | 12/1959 | Clark | 30/201 |
| 2,918,723 | 12/1959 | Levin | 30/200 |
| 2,941,293, | 6/1960 | Mazzoni | 30/201 |
| 2,974,412 | 3/1961 | Clark | 30/201 |
| 3,032,875 | 5/1962 | Gwynne | 30/200 |

(List continued on next page.)

FOREIGN PATENT DOCUMENTS

| | | | |
|---|---|---|---|
| 1209461 | 1/1966 | Fed. Rep. of Germany | 30/201 |
| 140656 | 1/1979 | Japan | 30/201 |

*Primary Examiner*—Jimmy C. Peters

*Attorney, Agent, or Firm*—Welsh & Katz, Ltd.

[57] ABSTRACT

The hair trimming apparatus disclosed herein is particularly adapted for trimming beards, mustaches and the like. It includes a hair clipper and a one-piece adjustable comb attachment. The comb attachment is slidably secured to the hair clipper by rails or the like which surround part of the clipper, such as the side edges of a stationary blade. The position of the comb attachment with respect to the blades is determined by placing any one of a plurality of indentations in the attachment over a protruding part of the clipper, such as one or more screw heads which secure one or more of the blades to the clipper. The position may be easily changed by merely moving the attachment to a different indentation. In this manner, the comb attachment may be easily secured to the clipper in any one of a number of positions, without manipulating other parts of the apparatus. In addition, fins on the comb attachment are recessed behind the clipper blades so that the clipper may more easily reach and trim mustache hair by cutting it in the direction of hair growth.

7 Claims, 12 Drawing Figures

U.S. PATENT DOCUMENTS

| | | | |
|---|---|---|---|
| 3,041,726 | 7/1962 | Hitson | 30/201 |
| 3,060,573 | 10/1962 | Clark | 30/201 |
| 3,115,143 | 12/1963 | Queen | 132/45 |
| 3,149,418 | 9/1964 | Milbourne | 30/201 |
| 3,262,200 | 7/1966 | Suozzi | 30/201 |
| 3,264,735 | 8/1966 | Du Charme | 30/202 |
| 3,267,572 | 8/1966 | Cordova | 30/201 |
| 3,287,805 | 11/1966 | Du Charme | 30/202 |
| 3,289,295 | 12/1966 | Tornvall | 30/202 |
| 3,320,668 | 5/1967 | Pucino | 30/201 |
| 3,334,416 | 8/1967 | Green | 30/200 |
| 3,387,367 | 6/1968 | Merzon | 30/201 |
| 3,648,370 | 3/1972 | Cercone | 30/201 |
| 3,969,819 | 7/1976 | Pepera | 30/200 |
| 3,979,825 | 9/1976 | Baumann | 30/201 |
| 3,986,258 | 10/1976 | Liedtke | 30/30 |

HAIR TRIMMING APPARATUS

BACKGROUND OF THE INVENTION

This invention relates to hair trimming apparatus, and more particularly to hair trimming apparatus which may be adjusted to cut hair any one of a number of selectable lengths.

Most modern electric hair clippers include two blades, one of which oscillates with respect to the other. Each blade has a row of hair cutting teeth, and the two rows of teeth are arranged parallel to and in contact with each other so that the tips of the teeth form a generally straight blade edge. Hair on a person or animal may be shorn to a desired length by pushing the oscillating blades through the hair a selected distance from the skin.

Comb attachments are provided with most hair clippers to maintain the blades a relatively fixed distance from the skin, so that the hair is cut substantially uniformly and the possibility of cutting the hair too short is reduced. Such attachments also protect the blades from damage.

Comb attachments usually have spaced fins which extend generally perpendicular to the blade edge. The operator may place a portion of the outer edges of the comb fins against or in proximity to the skin and push the clipper through the hair, cutting it as desired.

A comb attachment may be secured in fixed relation to a clipper, to cut hair a single length, or the attachment may be adjustable so that different hair lengths may be selected by the operator. Adjustable attachments are popular because only one attachment is needed, and adjustments may be made without removing and installing a number of comb attachments.

The installation of some operator adjustable comb attachments to a hair clipper requires additional parts such as spring clips and the like to secure the comb to the clipper. The use of such additional parts increases the cost of material and labor, and may result in higher maintenance costs and shorter life of the clipper.

A one-piece adjustable comb attachment for a hair clipper is available, but the attachment does not maintain contact with an exposed surface of the cutting blades in all positions of the attachment, creating a substantial space between the blades and the attachment. The space is closed behind the blades. As a result, cut hair may accumulate in the space between the cutting blade and the comb attachment. This is undesirable because such accumulated hair must be removed from the clipper and discarded. Thus, there is a need for adjustable one-piece comb attachments for hair clippers which do not require added parts for installation, and which do not accumulate hair clippings.

Hair generally does not grow perpendicularly out of the skin, but tends to grow at an angle with respect to the skin, and tends to naturally lie in a particular direction. When using an electric clipper, hair may be trimmed in the direction of hair growth, or with the lie of the hair. It may also be trimmed in the direction opposite to the direction of hair growth, or against the lie of the hair. If the hair is cut against the lie, the length of the hair remaining after it is cut is likely to be slightly shorter than it would be if the hair were cut with the lie.

Facial hair is preferably trimmed with the lie, to cut unruly hairs which curl away from the main growth of a beard or mustache, and to cut excessively long hairs, while at the same time leaving the appearance of a full growth of hair in the beard or mustache.

Most comb attachments are designed primarily for cutting hair on a person's head, or shearing the coat on an animal's hide. Clippers with such attachments do not easily cut mustaches and the like with the lie of the hair because mustache hair grows away from the nose, and the attachments are not adapted for permitting such hair to be cut with the lie because they touch the nose and prevent the blade from properly cutting the hair. For this reason, beards and mustaches are often cut with scissors. Since scissors generally do not trim hair as evenly or as easily as a hair clipper, there is a need for a comb attachment for hair clippers which is adapted for trimming mustaches, beards and the like by cutting the hair with the lie.

Accordingly, an object of this invention is to provide new and improved hair trimming apparatus.

Another object is to provide new and improved hair trimming apparatus which may be adjusted to cut hair any one of a number of selectable lengths.

Still another object is to provide new and improved hair trimming apparatus having a one-piece comb attachment which is adjustable with respect to the hair cutting edge of a hair clipper, and maintains substantial contact with the exposed surface of the cutting blades throughout the range of adjustment.

Another object is to provide new and improved hair trimming apparatus which is adapted for trimming beards, mustaches and the like by cutting the hair with the lie.

Yet another object is to provide new and improved hair trimming apparatus having a one-piece comb attachment which is adequately secured to a clipper in any one of a number of selectable positions without additional parts which are dedicated to the securement of the comb attachment, and which may be easily moved to any of the positions by the operator, without manipulating other parts of the clipper.

A still further object is to provide new and improved hair trimming apparatus having a one-piece comb attachment which may be secured in any one of a number of selectable positions by parts of the apparatus which perform one or more functions in addition to the securement of the comb attachment.

SUMMARY OF THE INVENTION

In keeping with one aspect of this invention, hair trimming apparatus includes a hair clipper and an adjustable one-piece comb attachment. The hair clipper has two blades. One blade is stationary, and the other blade oscillates with respect to the stationary blade. Each blade has a row of teeth which interfaces with the row of teeth of the other blade, and the tips of the teeth form a substantially straight blade edge for substantially uniformly cutting hair to a desired length.

The comb attachment has several fins which extend generally perpendicular to the blade edge. The outer edges of the fins provide several surface areas which, when placed close to the skin, determine the distance between the skin and the blades, and hence the length of the hair after it is cut. The portion of the outer edge of the fins which is behind the blades may be recessed towards the blades so that the clipper may more easily reach hair in confined spaces such as the upper lip.

The comb attachment is slidably secured to the hair clipper by rails or the like which surround part of the clipper, such as the side edges of the stationary blade.

The position of the comb attachment with respect to the blade edge is adjusted by placing any one of a plurality of indentations in the comb attachment over a protruding part of the clipper, such as one or more screw heads which secure one or more of the blades to the clipper. The comb attachment maintains contact with the cutting blades throughout the range of adjustment so that hair clippings do not accumulate between the clipper and the comb attachment. The position of the comb attachment may be easily changed by merely moving the attachment so that the protruding part resides in a different indentation. In this manner, the comb attachment may be easily secured to the clipper in any one of a number of positions, without manipulating other parts of the apparatus.

In one embodiment, the comb attachment is secured to the clipper by protrusions on the handle of the clipper which fit into the indentations in the comb attachment. In another embodiment, the protrusions are on the comb attachment and the indentations are in the hair clipper. Also, the outer edges of the attachment fins may form an arc to permit the attachment to more closely complement the shape of the upper lip when a mustache is trimmed. Various other alternate embodiments are described or contemplated.

BRIEF DESCRIPTION OF THE DRAWINGS

The above-mentioned and other features of this invention and the manner of obtaining them will become more apparent, and the invention itself will be best understood by reference to the following description of the invention taken in conjunction with the accompanying drawings in which.

DETAILED DESCRIPTION

Figure 1:
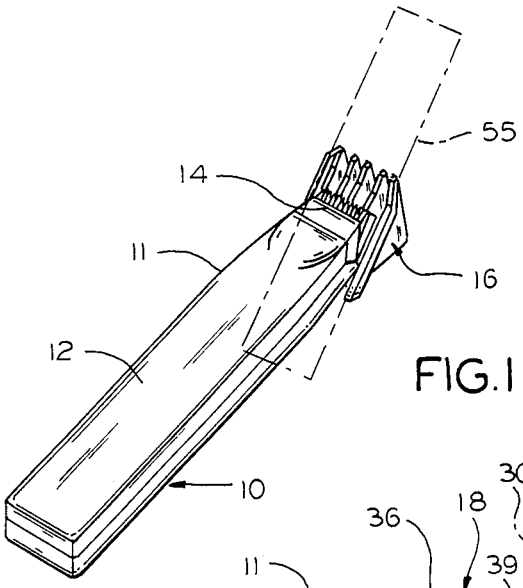
FIG. 1 is a perspective view of hair trimming apparatus made in accordance with this invention.

As seen in FIG. 1, hair trimming apparatus 10 includes a hair clipper 11 having a handle 13 and a head 14, and a comb attachment 16. The handle 12 includes a power source, such as batteries or the like, an electric motor and drive means (not shown) operatively connected to the head 14.

Figure 2:
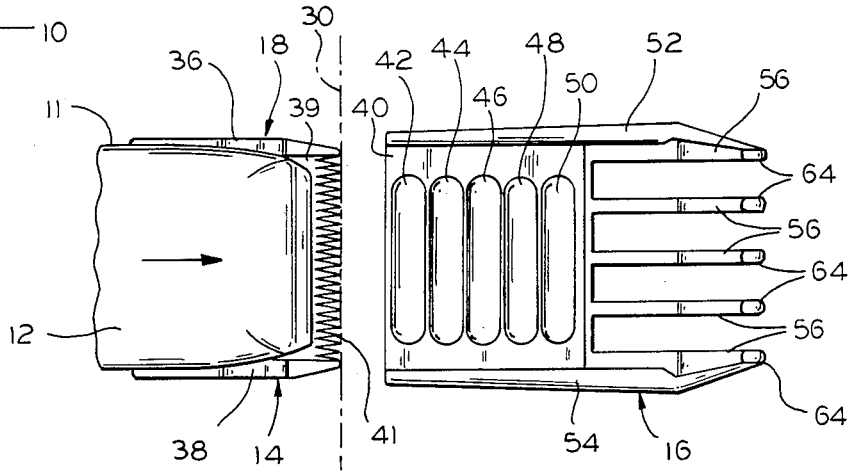
FIG. 2 is an exploded detail view of a portion of the apparatus of FIG. 1, showing the comb attachment detached from the hair clipper.
Figure 3:
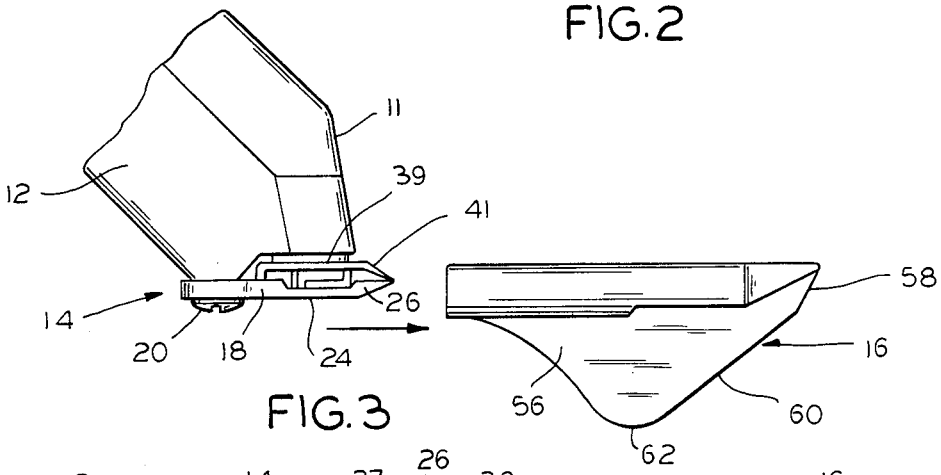
FIG. 3 is a side elevation view of the portion of the apparatus of FIG. 1 which is shown in FIG. 2.
Figure 4:
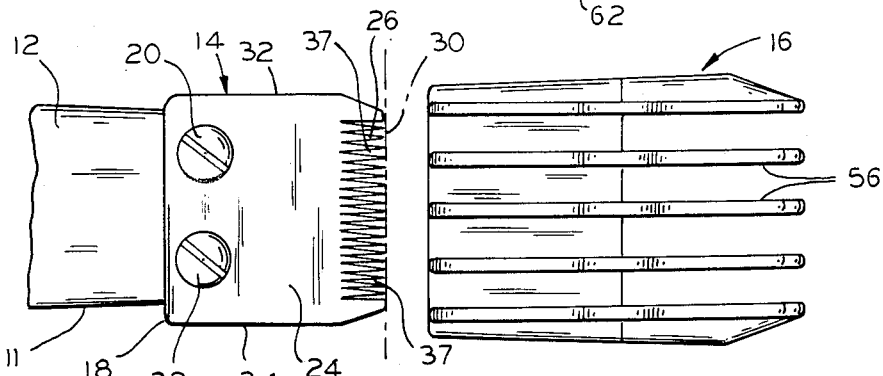
FIG. 4 is a top plan view of the portion of the apparatus of FIG. 1 which is shown in FIG. 2.
Figure 5:
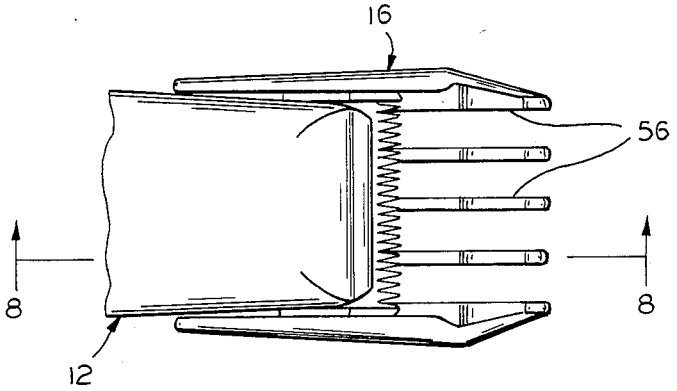
FIG. 5 is a detail view of a portion of the apparatus of FIG. 1, showing the comb attachment secured to the hair clipper.
Figure 6:
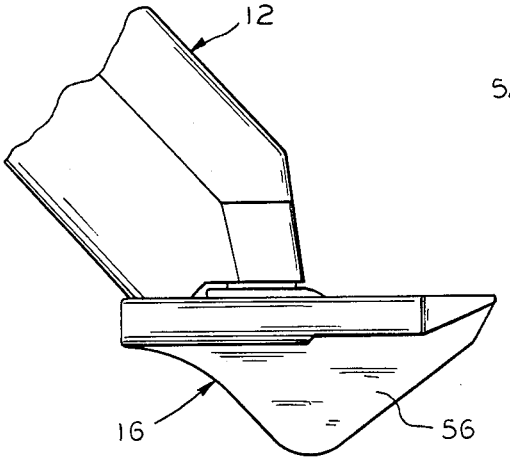
FIG. 6 is a side elevation view of the portion of the apparatus of FIG. 1 which is shown in FIG. 5.

FIGS. 2, 3 and 4 show the comb attachment 16 detached from the handle 12 and head 14. The head 14 (FIG. 3) includes a stationary blade 18 which is secured to the handle 12 by screws 20, 22. The heads of the screws 20, 22 protrude from a substantially flat surface 24 of the stationary blade 18. The surface 24 is exposed opposite the handle 12.

The stationary blade 18 has a set of teeth 26 (FIG. 4) arranged in a substantially straight row, and the tips of the teeth 26 form a substantially straight blade edge 30. The blade 18 also has side edges 32, 34 which are substantially perpendicular to the blade edge 30. The stationary blade 18 extends somewhat away from the handle 12 to provide exposed surfaces 36, 38, as seen in FIG. 2.

The head 14 also includes an oscillating blade 39 which has a set of teeth 41. The tips of the teeth 41 on the blade 39 cooperate with the tips of the teeth 26 to form a part of the blade edge 30. The teeth 41, in combination with the teeth 26, cut hair which enters a plurality of cavities 37 which are created as the blade 39 oscillates transverse to the blade edge 30. The blade edge 30 may have any desired dimensions, but is preferably short so that it is adapted for trimming beards, mustaches and the like.

The comb attachment 16 (FIG. 2) is preferably a one-piece part which is made of suitable molded plastic, and includes a generally planar portion 40 having a plurality of indentations 42, 44, 46, 48 and 50. Rails 52 and 54 are provided on the comb attachment 16 so that the comb attachment may be placed onto the head 14 by sliding it over the flat surface 24 of the stationary blade 18. The planar portion 40 is generally complementary to the surface 24 of the stationary blade, and the rails 52, 54 fit around the edges 32, 34, going across the exposed surfaces 36, 38 respectively.

The rails 52, 54 and the planar portion 40 are formed so that the planar portion 40 and the exposed flat surface 24 are in substantially the same plane 55 (FIG. 1), and at least part of the planar portion 40 and the exposed flat surface 24 are in substantial contact with each other regardless of the position of the comb attachment 16. The substantial contact between the two surfaces prevents hair clippings from accumulating between the flat surface 24 and the planar portion 40.

The screws 20, 22 fit into any one of the indentations 42, 44, 46, 48 or 50, securing the comb attachment 16 in place with respect to the head 14, and particularly with respect to the blade edge 30.

Figure 7:
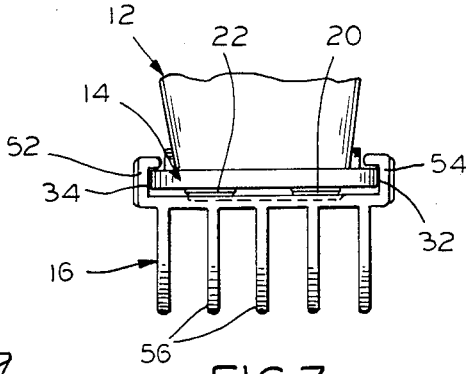
FIG. 7 is a rear elevation view of the portion of the apparatus of FIG. 1 which is shown in FIG. 5.
Figure 8:
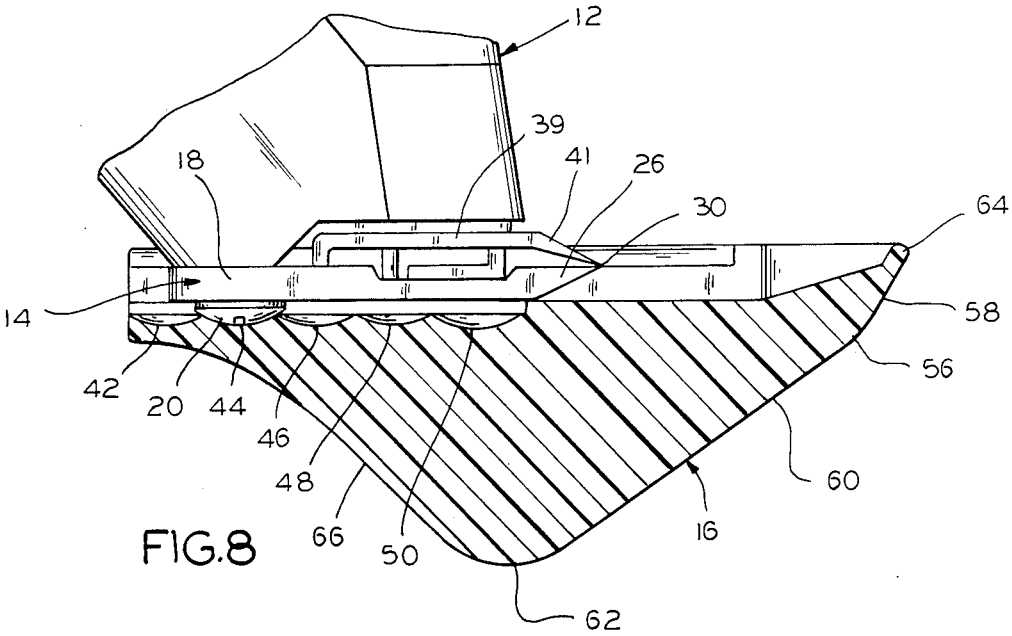
FIG. 8 is a cutaway side elevation view of the portion of the apparatus of FIG. 1 which is shown in FIG. 5, taken along lines 8—8.

The comb attachment 16 includes a plurality of fins 56 which extend away from the blade edge 30, as seen in FIGS. 7 and 8. Each of the fins 56 includes an extension 64 which is provided primarily for safety purposes, as will be seen.

FIGS. 5, 6, 7 and 8 show the attachment 16 secured to the head 14. FIG. 7 shows the manner in which the rails 52, 54 fit about the edges 32, 34, and FIG. 8 shows the manner in which the screw 20 fits into the indentation 44. When the attachment 16 is secured to the head 14, the attachment 16 has several edge surfaces 58, 60, 62 and 66 in FIG. 8, which have a predetermined relationship to the blade edge 30. The edge surface 60 is preferably long enough to provide stability and control of the apparatus 10 in use, by placing the edge 60 in proximity with the skin of the user, as will be described more fully.

The distance between the blade edge 30 and the edge surfaces 58, 60, 62 and 66 depends upon within which indentation the screws 20, 22 are positioned. For example, the distance between the blade edge 30 and the edge surface 60 is a maximum when the screws 20, 22 are positioned in the indentation 42, and a minimum when the screws 20, 22 are positioned in the indentation 50. If the operator attempts to push the attachment 16 to the left of the indentation 50 in FIG. 8, the blade edge 30 will strike the extensions 64, which will protect the skin from direct contact with the blade edge 30.

Figure 9:
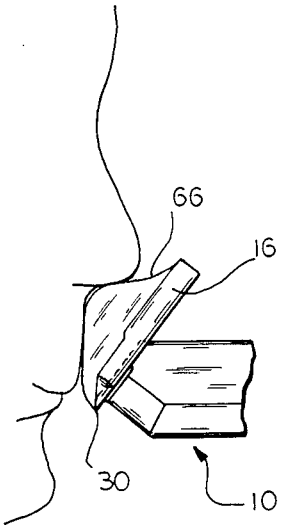
FIG. 9 is a side elevation view showing the apparatus of FIG. 1 in use.

The edge surface 66 is located behind and is recessed towards the blade edge 30. The inverted curvature of the edge surface 66 towards the blade edge 30 permits the apparatus 10 to trim hair beneath the nose, for example, while moving the blades in the direction of mustache hair growth, or with the lie, as seen in FIG. 9.

Figure 10:
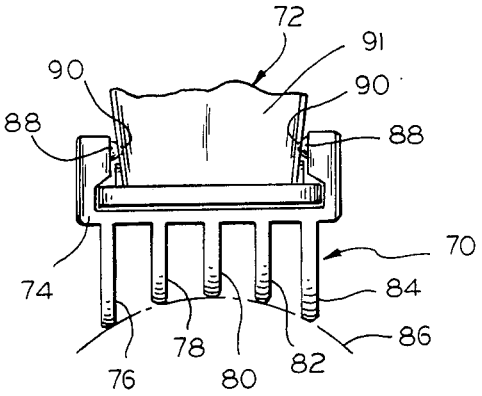
FIG. 10 is a rear elevation view of an alternate embodiment of the apparatus of FIG. 1.

An alternate embodiment of the apparatus 10 of FIGS. 1 through 9 is shown in FIG. 10. Apparatus 70 includes a hair clipper 72 and a comb attachment 74 which are generally similar to the clipper 11 and comb attachment 16, respectively, of FIG. 1. The comb attachment 74 has a plurality of fins 76, 78, 80, 82 and 84, the outer edges of which form an arc 86, approximately as shown. The arc 86 is formed so that the upper lip of a person generally fits into the recess created by the arc 86. Thus, this embodiment is particularly adapted for use in trimming mustaches.

The embodiment of FIG. 10 also includes protrusions 88 on the comb attachment 74, and a plurality of indentations 90 on a handle 91 of the clipper 72. The protrusions 88 secure the comb attachment 74 in one of a number of adjustable positions with respect to the clipper 72 when the protrusions 88 are in selected indentations 90.

Figure 11:
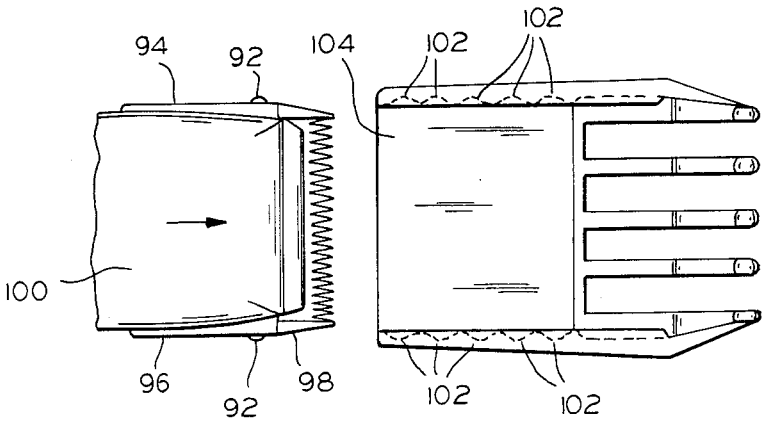
FIG. 11 is an exploded detail view of an alternate embodiment of the apparatus of FIG. 1.
Figure 12:
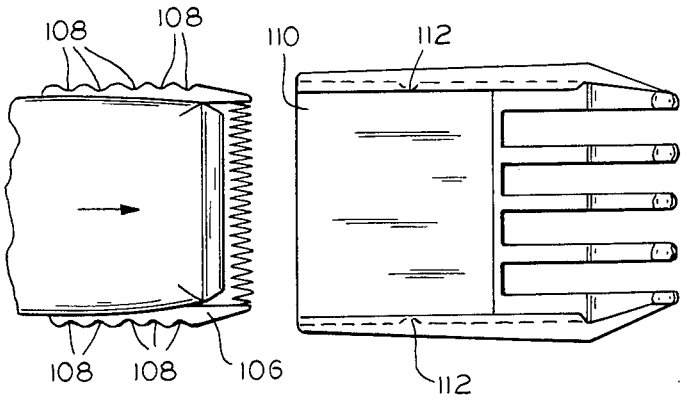
FIG. 12 is an exploded detail view of another alternate embodiment of the apparatus of FIG. 1.

Additional alternate embodiments are shown in FIGS. 11 and 12. In FIG. 11, protrusions 92 are provided on sides 94, 96 of a blade 98 on a hair clipper 100. Corresponding indentations 102 are provided in a comb attachment 104 for securing the comb attachment 104 in a desired fixed relationship with the clipper 100. Similarly, in FIG. 12, a blade 106 is provided with a plurality of indentations 108, and a comb attachment 110 is provided with protrusions 112 for securing the blade 106 and comb attachment 110 in fixed relation. Other arrangements of the protrusions and indentations are contemplated.

In one embodiment of FIGS. 1 through 9, the blade edge 30 can extend about 0.875 inches. The edge surface 58 (FIG. 8) can be about 0.25 inches long, the edge surface 60 can be about 0.800 inches long, and the edge surface 62 can be about 0.25 inches long. The edge surface 66 an be about 1.125 inches long, extending inwardly about 0.062 inches from a straight line. The blade edge 30 can be about 0.56 inches from the edge surface 60 when the screws 20, 22 are in the indentation 42, about 0.44 inches from the edge surface 60 when the screws 20, 22 are in the indentation 44, about 0.31 inches from the edge surface 60 when the screws 20, 22 are in the indentation 46, about 0.25 inches from the edge surface 60 when the screws 20, 22 are in the indentation 48, and about 0.125 inches from the edge surface 60 when the screws 20, 22 are in the indentation 50.

In operation, the comb attachment 16 (FIGS. 1–9) may be easily secured to the head 14 without the use of hand tools or the like, by simply slipping the rails 52, 54 over the edges 32, 34 and engaging the screws 20, 22 in one of the indentations 42, 44, 46, 48 or 50. Any of the edge surfaces 58, 60 or 62 may be placed in proximal contact with the skin surface of the subject whose hair is to be trimmed, although the edge surface 60 is generally preferred. Often only proximal contact with the skin, rather than actual contact therewith, may be attained due to the presence of hair between the outer edges of the fins and the skin when the operator attempts to place the fins against the skin. The operation of the embodiments shown in FIGS. 10, 11 and 12 is similar to that of the embodiment of FIGS. 1 through 9. The arc 86 makes the embodiment of FIG. 10 particularly adapted for use in trimming mustaches.

The length of the hair after it is cut will be determined by which of the edge surfaces 58, 60 or 62 rests close to the skin, the angle of the attachment 16 with respect to the skin and the distance between the selected edge surface and the blade edge 30. The hair will be cut to the longest length when the screws 20, 22 are in the indentation 42, and to the shortest length when the screws 20, 22 are in the indentation 50. The length of the hair will also be determined in part by whether the blade is moved across the hair with the lie or against it.

This hair trimming apparatus is particularly adaptable to trimming beards and mustaches, and may be used to trim one's own facial hair. The comb attachment easily reaches and trims mustaches, beards and the like by cutting the hair in the direction of growth because the comb fins are recessed behind the blades. Also, the length of the cut hair may be easily changed because the comb attachment can be adjusted with the fingers, without the use of any hand tools or the like, so that portions of a beard may be cut shorter than other portions, and a mustache may be cut shorter than a beard, if desired.

The many advantages of this invention are now apparent. The one-piece construction of the comb attachment eliminates the need for additional parts, which reduces material and labor costs, reduces maintenance costs and increases product life. In addition, the comb attachment may be secured to the clipper by parts of the clipper which perform one or more functions in addition to the securement of the comb attachment, and the attachment may be moved easily by the operator without manipulating other parts of the clipper. Also, the apparatus trims beards, mustaches and the like exceptionally well, without accumulating hair clippings in the apparatus which must later be removed and discarded.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed:

1. Apparatus for trimming hair to a predetermined distance from the skin comprising:

a hair clipper having cutting means and handle means secured to said cutting means for controlling said cutting means; and one-piece comb means adjustably secured to said hair clipper for determining said predetermined distance, said comb means including a plurality of fins extending away from said cutting means, said fins each having an outer edge which may be placed in proximal contact with said skin to determine the distance between said cutting means and said skin, a portion of said outer edges behind said cutting means being recessed towards said cutting means, said recessed portion having an outer edge surface which is about 1.125 inches long, and extends inwardly about 0.062 inches from a straight line, whereby said apparatus may trim hair in confined spaces such as the upper lip by cutting said hair in the direction of growth.

2. Apparatus for trimming hair to a desired length from the skin comprising:

a handle;

drive means positioned within said handle;

an oscillating blade secured to said handle, said oscillating blade being operatively connected to said drive means for oscillation of said blade;

a stationary blade secured to said handle by a plurality of screws, each of said screws having a head which protrudes away from said stationary blade and said handle, said stationary blade having a substantially flat surface opposite said handle, and two side edges;

said oscillating blade and said stationary blade each having a set of teeth which complement each other, said teeth having tips which form a substantially straight blade edge; and a one piece comb attachment having a substantially planar surface for slideable contact with said flat surface of said stationary blade, a rail at each of two ends of said planar surface for slideable securement of said comb attachment about said side edges of said blade, and a plurality of indentations in said planar surface for adjustable securement of said comb attachment with respect to said stationary blade;

said protruding screws fitting within said indentations for securing said comb attachment with respect to said stationary blade;

said comb attachment having a plurality of fins extending generally perpendicular to said blade edge, said fins having an outer edge surface for proximal contact with said skin, the distance between said outer edge and said blade edge substantially determining the length of said trimmed hair.

3. Apparatus for trimming hair to a predetermined distance from the skin comprising:

a hair clipper having hair cutting means and handle means secured to said cutting means for controlling said cutting means; and one-piece comb means adjustably secured to said hair clipper for determining said predetermined distance, said comb means maintaining substantial contact with said cutting means to prevent the excessive accumulation of hair clippings in said apparatus;

said hair cutting means including a stationary blade secured to said handle means, and at least one screw which secures said stationary blade to said handle means and protrudes from said stationary blade, said comb means including a plurality of indentations adapted to cooperate with said screw, whereby said comb means can be secured with respect to said cutting means with said screw positioned in one of said indentations.

4. The apparatus of claim 3 wherein said stationary blade includes a substantially flat surface opposite said handle, said stationary blade having a substantially straight blade edge, a side edge on each side of said blade edge, and an exposed surface adjacent to and substantially perpendicular to each of said side edges opposite said flat surface, said screw protruding from said flat surface, and said comb means includes a substantially planar surface area complementary to said flat blade surface, and a rail complementary to each of said side edges extending over at least a portion of said exposed surfaces, said indentations being formed in said planar surface area, whereby said comb means is adjustably secured to said stationary blade by slidng said rails over said side edges and positioning said screw in one of said indentations.

5. The apparatus of claim 4 wherein said comb means includes a plurality of fins extending away from said cutting means and said handle, said fins each having an outer edge surface which may be placed in proximal contact with said skin to determine the distance between said cutting means and said skin, a portion of said outer edge surfaces behind said cutting means being recessed towards said cutting means, whereby said apparatus may trim hair in confined spaces such as the upper lip.

6. The apparatus of claim 4 wherein said comb means includes a plurality of fins extending away from said cutting means and said handle, at least one of said fins including an extension for preventing said blade edge from contacting said skin if said comb means slides beyond all of said indentations.

7. Apparatus for trimming hair to a desired length from the skin comprising:

a handle;

drive means positioned within said handle;

an oscillating blade secured to said handle, said oscillating blade being operatively connected to said drive means for oscillation of said blade;

a stationary blade secured to said handle by at least one screw, said screw having a head which protrudes away from said stationary blade and said handle, said stationary blade having a substantial flat surface opposite said handle, and two side edges;

said oscillating blade and said stationary blade each having a set of teeth which complement each other, said teeth having tips which form a substantially straight blade edge;

a one piece comb attachment having a substantially planar surface of slidable contact with said flat surface of said stationary blade, a rail at each of two ends of said planar surface for slidable securement of said comb attachment about said side edges of said blade, and at least one indentation in said planar surface for securement of said comb attachment with respect to said stationary blade;

said protruding screw fitting within said indentation for securing said comb attachment with respect to said stationary blade;

said comb attachment having a plurality of fins extending generally perpendicular to said blade edge, said fins having an outer edge surface for proximal contact with said skin, the distance between said outer edge and said blade edge substantially determining the length of said trimmed hair.

* * * * *

UNITED STATES PATENT AND TRADEMARK OFFICE

CERTIFICATE OF CORRECTION

PATENT NO. : 4,622,745

DATED : November 18, 1986

INVENTOR(S) : Gregory S. Wahl

It is certified that error appears in the above-identified patent and that said Letters Patent is hereby corrected as shown below:

Column 3, line 64, change "13" to --12--.

Column 8, line 41, change "substantial" to --substantially--.

Signed and Sealed this

Twenty-fourth Day of February, 1987

*Attest:*

DONALD J. QUIGG

*Attesting Officer* *Commissioner of Patents and Trademarks*